United States Patent [19]

Roppatte, Jr.

[11] Patent Number: 4,602,651

[45] **Date of Patent: * Jul. 29, 1986**

[54] LIQUID APPLICATOR DEVICE WITH HAIR-PARTING WAND

[76] Inventor: Michael Roppatte, Jr., 104 Shrewsbury Dr., Livingston, N.J. 07039

[ * ] Notice: The portion of the term of this patent subsequent to Oct. 19, 1999 has been disclaimed.

[21] Appl. No.: 631,512

[22] Filed: Jul. 17, 1984

Related U.S. Application Data

[63] Continuation of Ser. No. 434,738, Oct. 18, 1982, abandoned, and a continuation-in-part of Ser. No. 910,471, May 30, 1978, Pat. No. 4,354,512.

[51] Int. Cl.[4] ..... A45D 40/30

[52] U.S. Cl. ..... 132/88.5

[58] Field of Search ..... 132/88.5, 88.7, 112; 128/269

[56] References Cited

U.S. PATENT DOCUMENTS

| | | | |
|---|---|---|---|
| 1,137,792 | 5/1915 | Scheel | 132/112 |
| 1,516,454 | 11/1924 | Norton | 128/269 |
| 2,819,723 | 1/1958 | Meyer | 132/116 |
| 2,895,486 | 7/1959 | Sayer | 132/9 |
| 2,956,570 | 10/1960 | Stanford | 132/116 |
| 3,368,569 | 2/1968 | Lawrence | 132/124 X |
| 4,211,247 | 7/1980 | Morganroth | 132/88.7 |
| 4,222,677 | 9/1980 | Cervantes | 132/88.7 |
| 4,294,270 | 10/1981 | Cochran | 132/112 |
| 4,310,009 | 1/1982 | Shipp | 132/88.5 |

*Primary Examiner*—Gregory E. McNeill

[57] ABSTRACT

A liquid applicator device is disclosed, useful in applying bleaching or coloring compositions or the like to the hair in the course of cosmetically treating same. The device comprises a compressible container for receiving the compositions; a dispensing tube is connected to the container and including an opening therethrough for feeding the composition upon manual compression of the container. Dispenser means, including liquid distribution means, are disposed at the distal end of tube and extend transverse to a longitudinal axis of the tube. A hair-parting wand extends from the cap at an angle diverging from the direction of extension of the brush, whereby a user of the device may employ the wand to part and separate the hair and thereupon utilize the brush to apply the treating composition. Various embodiments of the invention are disclosed.

20 Claims, 12 Drawing Figures

FIG. 1
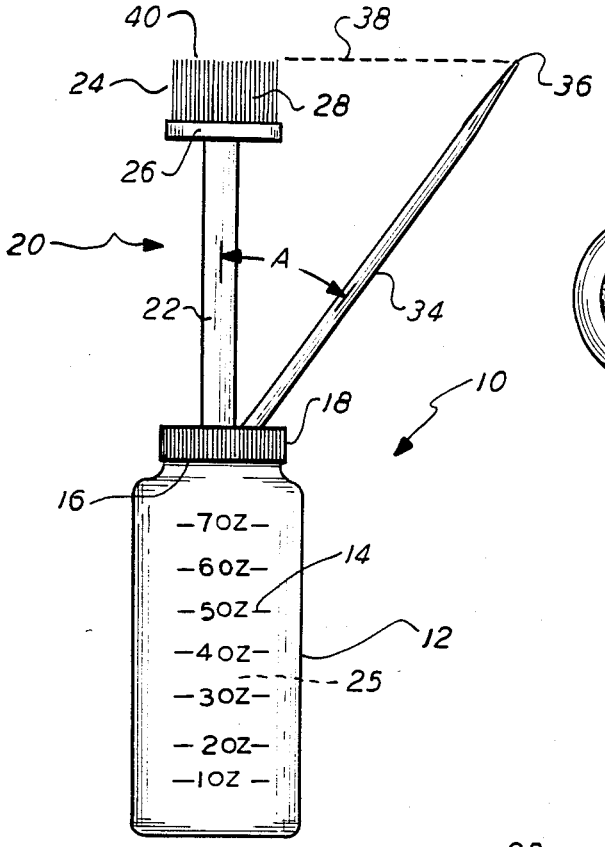
FIG. 2
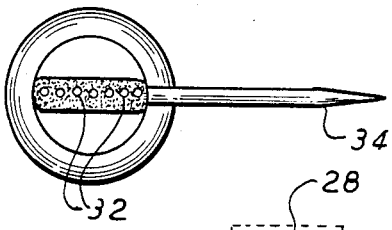
FIG. 3
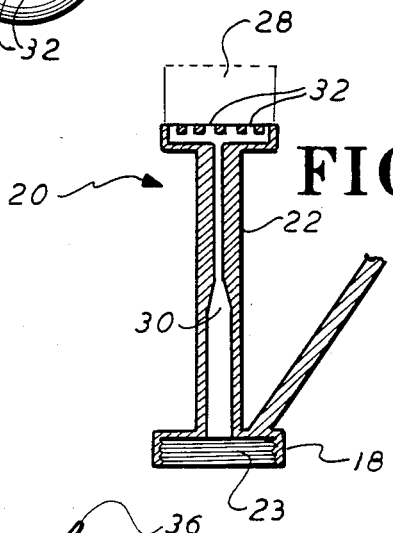
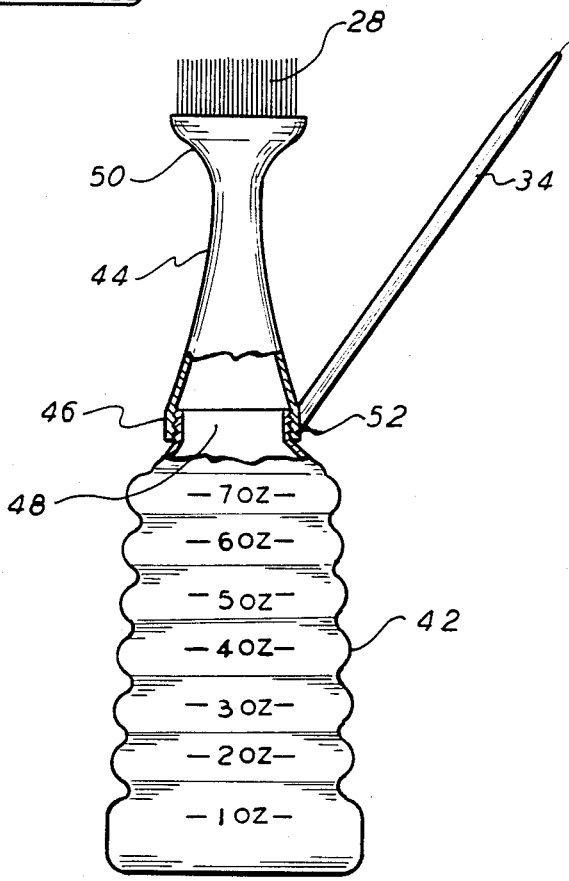
FIG. 4

FIG. 7
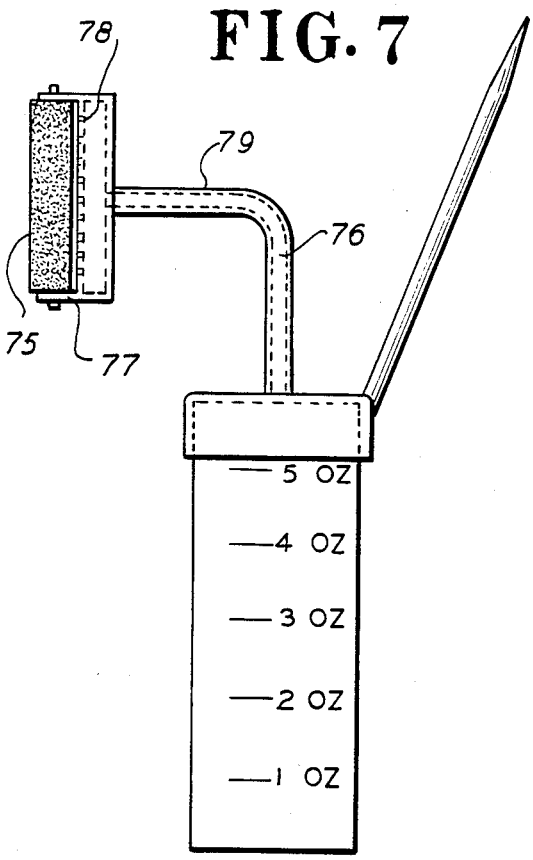
FIG. 8
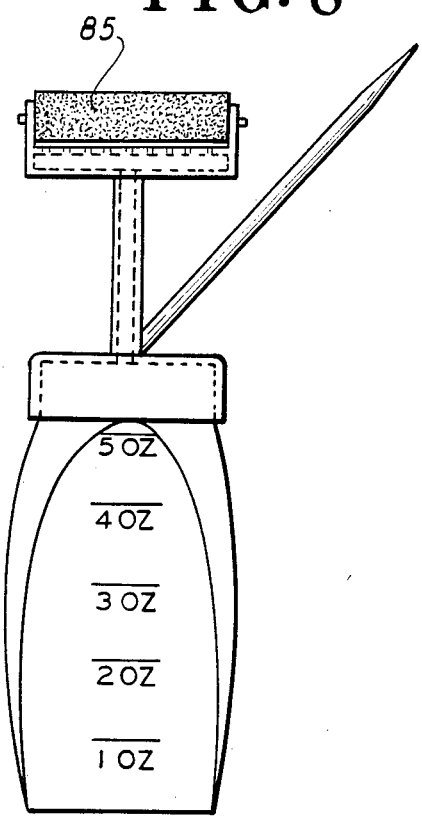
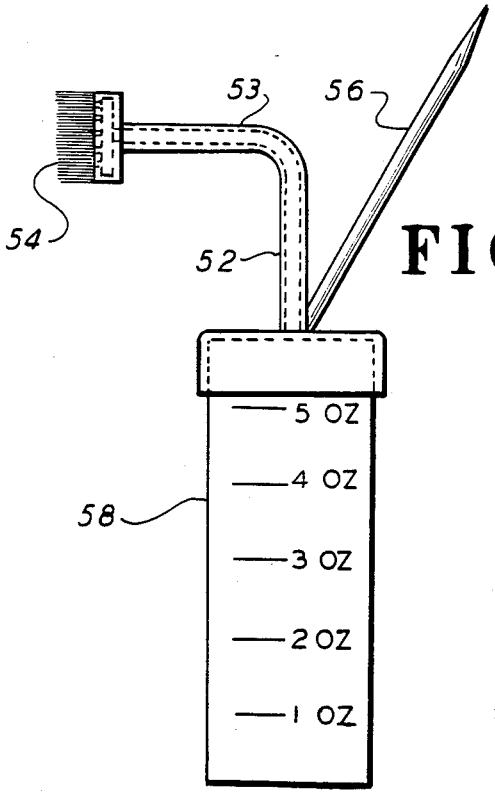
FIG. 5
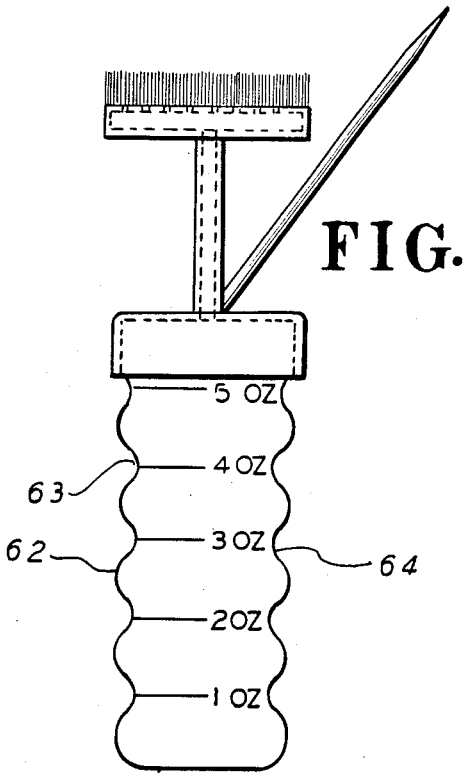
FIG. 6

LIQUID APPLICATOR DEVICE WITH HAIR-PARTING WAND

This application is a continuation of application Ser. No. 434,738, filed Oct. 18, 1982, now abandoned and a continuation-in-part-of application Ser. No. 910,471, filed May 30, 1978, now U.S. Pat. No. 4,354,512.

BACKGROUND OF INVENTION

This invention relates generally to apparatus useful in the art of hair-dressing, and more specifically relates to a liquid applicator device useful in applying bleaching and coloring compositions to the hair.

Particularly in the course of effecting hair-dressing operations upon women's hair, the hair-dressing operator is called upon to skillfully treat the hair to effect such operations as highlighting, toning, bleaching, streaking or frosting, all of the cited terms being well-known to those skilled in the pertinent art. Such operations require the use of relatively skilled techniques to manipulate the hair and therupon apply to same liquid compositions which may effect bleaching or coloring of the hair in varying degrees, or may effect selective degrees of bleaching and coloring in accordance with the effect desired.

In the common procedure utilized by the hair-dresser in carrying out the foregoing operations, the treating solution, be it a bleach, dye or composite solution or the like, is maintained in a distinct container or reservoir, such as a bowl or the like. The operator positions this reservoir at a convenient location, and utilizes for application of the composition, a brush which is periodically dipped into the container. Intermittently, the operator utilizes a separate hair-parting instrument—e.g. the "rattail" end of a common rattail-comb—to periodically part the hair in order to render accessible portions of same which are to be treated. The sequence of operation thus involves a continuing alternation of instruments, including in such alternation the repeated dipping of the brush into the composition resevoir, and repeated (but necessary) movement of the operator's hands away from the hair work area.

The operations required pursuant to the foregoing approach are not only cumbersome, but tend to be ineffective from an efficiency and artistic viewpoint. Indeed, a great degree of skill is required to manually carry out the cited sequence of steps—this quite aside from the operator's talent in carefully applying the composition to the hair.

Pursuant to the foregoing, it may be regarded as an object of the present invention, to provide a liquid applicator device useful in carrying out such hair-dressing operations in high-lighting, toning, bleaching, streaking, frosting or the like, which device enables the operator to simply and effectively conduct the said operations without using separate instruments, and without diverting his or her attention from the work area.

SUMMARY OF THE INVENTION

Now in accordance with the present invention, the foregoing object and others as will become apparent in the course of the ensuing specification, are achieved in a liquid applicator device useful for applying compositions to the hair in the course of cosmetically treating same. The device finds application in the course of applying compositions useful in highlighting, toning, bleaching, streaking or frosting, or in similar operations pertinent to cosmetically treating hair.

A device in accordance with the invention may comprise a compressible container for receiving the composition to be dispensed. A dispensing tube is connected to the container and includes an opening therethrough for feeding the composition upon manual compression of the body. Applicator means, including liquid distribution means, are positioned at the distal end of the dispensing tube and extend transversely to a longitudinal axis of the dispensing tube. Pursuant to a preferable form of the invention, a hairparting wand, as for example of the well-known tapering "rattail" variety, may extend from the cap at an angle which diverges from the direction of extension of the applicator means. In consequence, a user of the said device may readily employ the wand to part and separate the hair, and thereupon utilize the applicator means to skillfully apply the composition to the parted hair.

The angle of divergence between the applicator means and the wand is at least 15°, and preferably between about 25° and 45°. The applicator means may extend along the longitudinal axis of the container, with the distal end of the applicator and the tip of the wand lying approximately on a line perpendicular to the said longitudinal axis, to thereby enable manipulation by the operator of the device between the liquid application and hair-parting positions of the device. In typical embodiments of the device, the lateral separation between the distal end of the brush and the wand tip is between about 2 and 5 inches, as this is found to provide a relatively optimal spacing permitting the foregoing operations without either the brush and wand interfering with the use of each other.

BRIEF DESCRIPTION OF THE DRAWINGS

The invention is diagrammatically illustrated, by way of example in the drawings appended hereto, in which:

FIG. 1 is an elevational view of a first embodiment of a device in accordance with the present invention;

FIG. 2 is a top plan view of the device of FIG. 1;

FIG. 3 is a longitudinal, cross-sectional view through the cap and associated brush and wand structure;

FIG. 4 is a side elevational view, partially sectioned, showing a further embodiment of a device in accordance with the invention;

FIG. 5 is an elevational view of an embodiment which is a variant of that shown in FIG. 1.

FIG. 6 is an elevational view of an embodiment having a different shaped container;

FIG. 7 is an elevational view of another embodiment using an applicator roller;

FIG. 8 is an elevational view of a variant of the embodiment shown in FIG. 7;

DESCRIPTION OF PREFERRED EMBODIMENT

Figure 9:
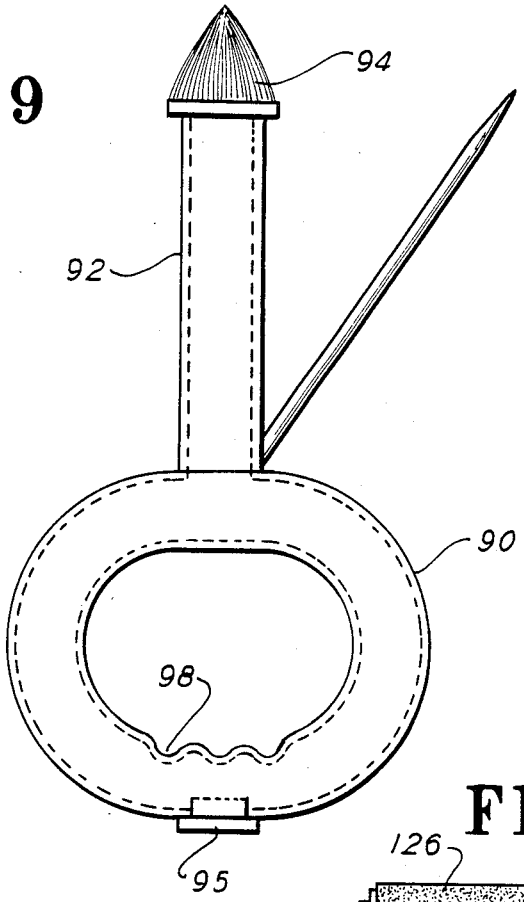
FIG. 9 is an elevational view of another embodiment using a different container.

Referring to FIGS. 1, 2, and 3 herein, an applicator device 10 in accordance with the invention is set forth. Device 10 is seen to include a reservoir or container 12, which is per se of generally conventional design, and which is intended to receive the treating solution or composition utilized in the present device. Typically, container 12 will include visual marking indicia 14 formed thereon, specified for example in fluid ounces. Such indicia, as is known in this art, are useful in the course of preparing the treating solutions, i.e. in some instances these solutions or compositions are prepared by mixing two or more components.

Container 12 preferably comprises a compressible flexible plastic material, such as polyethylene or the like; i.e. this container is of the well-known "squeeze bottle" variety, it being the objective of the present structure to enable liquid to be dispensed by manual compression of the said container. The manual compression, i.e. the pumping action thereby effected, is usually necessary when dispensing compositions of the most common type to which the present device is applicable—in that such compositions are often quite viscous, and do not flow readily under mere gravitational influence.

The top end of container 12 is open, and is provided with conventional threads 16. A cap 18, of plastic, metal, or other suitable material, carries internal mating threads, and is received by being threaded upon the top end of container 12.

Extending upwardly along the longitudinal axis of container 12, is a brush means generally indicated at 20. Such brush means includes a dispensing tube 22, which as seen in FIG. 3 is in communication with the cap opening 23, and therefore with the interior 25 of container 12. Tube 22 terminates at a brush 24, which includes a base 26 and bristle portion 28.

By reference to FIG. 3, it is seen that an internal channel 30 passing through tube 22, forms part of a liquid distribution system which includes a plurality of ports or outlets 32 at base 26 of brush 24. These ports 32 permit the liquid from container 12, upon compression of the latter, to be exuded into the bristles 28, to enable application to the hair.

Pursuant to the invention it is further seen that a hair-parting wand 34 extends from cap 18 at an angle A with respect to the direction of extension of brush means 20. Wand 34 may per se resemble—although in a somewhat extended form—the "rattail" portion of a so-called "rattail" comb. The wand is used to part the hair during the use of the present device in the hairdressing operations previously mentioned.

The angle A is referably at least 15°, and more generally between about 25° to 45°, with 30° to 35° being a relatively optimal angle.

The tip 36 of wand 34 preferably resides approximately on a line 38 which about coincides with the distal end 40 of bristles 28 and is perpendicular to the longitudinal axis of container 12 and tube 22 of the brush means. When coupled with the diverging angle A previously mentioned, this provides a typical separation between the distal end 40 of the brush and wand tip 36 of the order of 2 to 5 inches. With the said distal end 40 and tip 36 lying on the common line 38, and the indicated separation, a relatively optimal use of device 10 may be achieved, i.e. with this arrangement the operator may most readily manipulate the device 10 between its liquid applicator positions, and its hair-parting positions, without the wand 34 or brush means 20 interfering with one another in use. All these operations, may of course, be readily effected with but one hand, and there is no necessity to move the device 10 away from the work area, i.e. from the hair during the said operations.

In FIG. 4 herein, an elevational view, partially sectioned, appears of a further embodiment of the present device. The apparatus shown is in most respects similar to that of FIGS. 1, 2, and 3. It will, however, be noted firstly that the container 42 differs somewhat from container 12, in having more rounded side walls—which renders the container more comfortable to grasp and easy to use.

The embodiment of FIG. 4 has a yet further, significant advantage. In particular, it will be seen that the neck 44 at its lower or base end 46, has an opening substantially as wide as that of the passageway 48 through the cap. This is especially advantageous for present applications, since the aforementioned high viscosity of the compositions often used in the present device, tend to prevent ready flow of same—a condition rectified by the instant arrangement. At the upper end of tube 44 it is seen that the walls of same flare out at 50, to provide a fluid distribution system substantially similar to that shown in the cross-sectional view of FIG. 3. It is also to be noted in the present arrangement, that the wand 34 is now secured to the cap at its side or periphery 52, instead of being secured at the upper side thereof.

As will be seen from FIG. 5, the dispensing tube 52 has a portion 53 that is bent at angle e.g. 90° as shown, the brush 54, being positioned at the end of the bent portion 53 of the tube with its principal axis transverse to the axis of the bent portion of the tube. The wand 56, as in FIG. 1, forms an angle with the portion 52 of the tube extending from the container 58. The end of the wand is now even further removed from the brush 54.

FIG. 6 shows an embodiment similar to FIG. 1 in which the container 62 has an undulating outer contour 63 permitting the container to be grasped in the hand of an operator whose fingers can fit into the depressions 64 to facilitate squeezing of the bottle.

FIG. 7 shows another embodiment similar to FIG. 1 in which the brush is replaced by a roller 75 made of sponge to use in rolling a color onto the hair. Roller 75 is journaled for rotation in a yoke 77. Fluid is fed to the roller via channel 76 in tube 79, and the openings 78 in roller yoke 77.

FIG. 8 shows an embodiment similar to FIG. 6, in which the brush 54 is replaced with a roller 85 made of sponge, and mounted and fed as in FIG. 7.

FIG. 9 shows an embodiment in which the container is a toroidal-shaped squeeze bulb 90 having a dispensing tube 92 extending directly out from an opening in the bulb, thus forming a syringe. An applicator 94 which may be a brush, such as shown in FIGS. 1, 5, or 6, or a roller made of sponge as shown in FIGS. 7 and 8 may be used. A filling cap 95 is provided which is located at another location in the bulb remote from the dispensing tube 92. The inner bottom wall is preferably corrugated as shown at 98 to facilitate gripping with a hand and squeezing.

Figure 10:
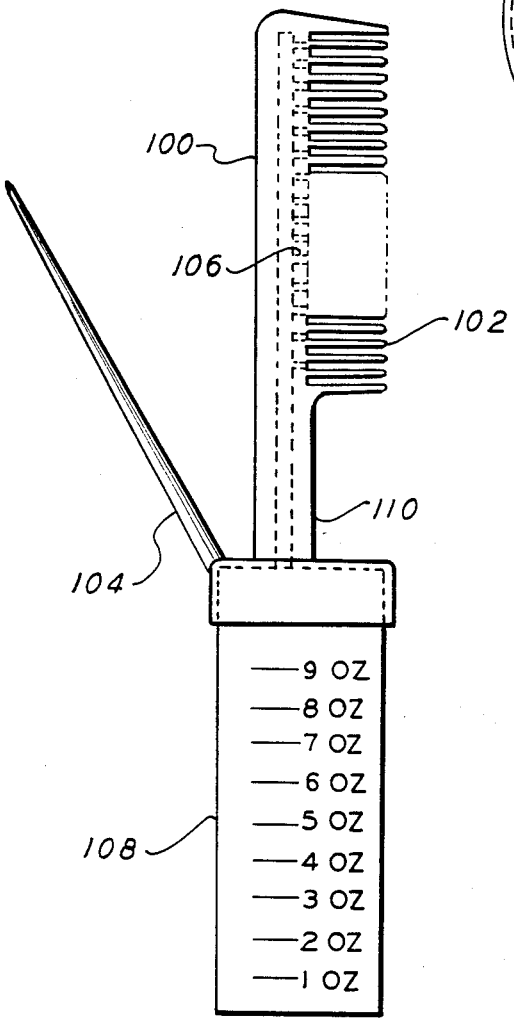
FIG. 10 is an elevational view of another embodiment in which a comb applicator is used.

FIG. 10 shows still another embodiment in which, in addition to, or as a replacement for the brush or sponge applicator shown in the other Figures, a comb 100 whose tines 102 extend transversely to the axis of the comb, and away from the wand 104. The comb which may be hollow and provided with dispensing apertures 106, is connected to the container 108 by the dispensing tube 110, so that the composition in the container 108 may be dispensed by the comb tines.

Figure 11:
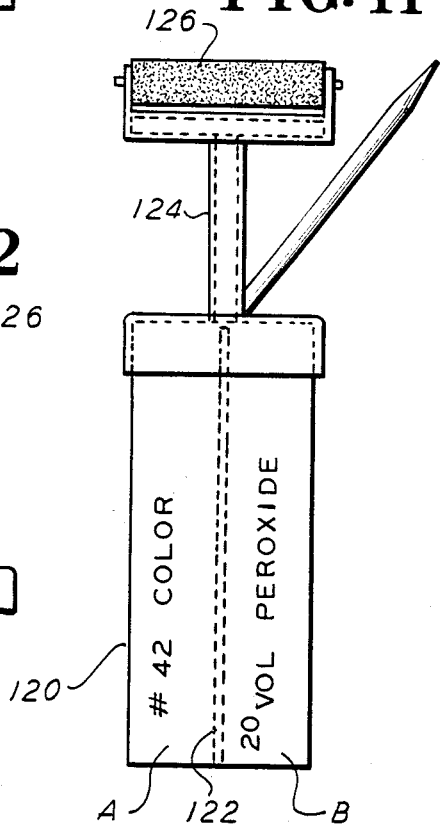
FIG. 11 is an elevational view of another embodiment using a mixing bottle container.
Figure 12:
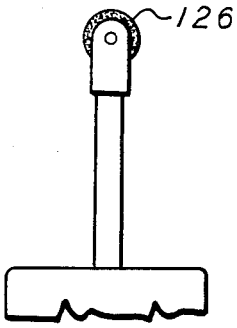
FIG. 12 is a fragmentary side view of the top portion of the device in FIG. 11.

FIG. 11 shows still another embodiment in which the container 120 is divided into at least two portions A and B by a frangible partition 122. When the bottle is squeezed, the partition breaks, and the compositions in compartments A and B mix. For example, compartment A may contain a hair-coloring composition, and compartment B may contain a bleach, such as hydrogen peroxide. The container 120 is connected with a dispensing tube 124, at the distal end of which an applicator, i.e. either a brush or a roller 126 is positioned transverse to the axis of the dispensing tube. The operator, by squeezing container 120 causes the compositions to mix for creating special coloring effects. The roller 126 is shown in side view, in the fragmentary view of FIG. 12.

It will be appreciated that the entire structure including the cap, applicator means and wand, may in the device shown, be formed substantially as a molded unit (except for the brush bristles which can be inserted by customary techniques); or the various elements can be separately formed and joined by known methodology.

It will also be appreciated that the structure including the cap, wand and associated applicator means can be made in various sizes as to enable the use of these elements in combination with standard "off the shelf" squeeze bottles.

While the present invention has been particularly set forth in terms of specific embodiments thereof, it will be understood in view of the present disclosure, that numerous variations upon the invention are now enabled to those skilled in the art, which variations yet reside within the scope of the present teaching. Accordingly, the invention is to be broadly construed, and limited only by the scope and spirit of the claims now appended hereto.

I claim:

1. A liquid applicator device for applying compositions to hair in the course of cosmetically treating the same; said device comprising:

a compressible container for receiving said composition;

a dispensing tube connected to said container for delivering said composition;

an applicator positioned at the end of said dispensing tube remote from said container for receiving and distributing said composition; and a non-dispensing hair-parting wand extending from said container along an axis which diverges from the longitudinal axis of said container, the end of said hair-parting wand being spaced from and unobstructed by the applicator to enable manipulation of the hair without interference by the applicator.

2. A device as claimed in claim 1, in which the compressible container is a bulb and the dispensing tube is connected to the bulb for delivering the composition in the bulb to the applicator.

3. A device as claimed in claim 2, in which the bulb has a filling cap for introducing the composition dispensed from the dispensing tube.

4. A device as claim in claim 3, in which the inner wall of the bulb remote from the dispensing tube is corrugated to form a hand grip to aid in compression of the bulb.

5. A device as claimed in claim 1, in which the applicator includes a comb.

6. A device as claimed in claim 1, in which the compressible container has an internal partition dividing the container into a plurality of compartments each for holding a separate composition.

7. A device as claimed in claim 6, in which the partition is frangible allowing it to break upon compression of the container to promote mixing of the compositions.

8. A device as claimed in claim 6 in which the applicator is a sponge roller.

9. A device as claim in claim 6, in which at least one compartment contains a bleaching composition.

10. A device as claimed in claim 6, in which another compartment contains a coloring composition.

11. A device as claimed in claim 5, in which the comb has tines which extend transverse to the axis of the dispensing tube.

12. A device as claimed in claim 1, in which the dispensing tube is bent and the applicator is at the distal end of the bent portion of the dispensing tube.

13. A device as claimed in claim 1, in which the external surface of the container is undulated with depressions to facilitate gripping and squeezing by an operator.

14. A device as claimed in claim 5, in which the comb is hollow and connected to the container by a tube for dispensing tube for dispensing color with the lines of the comb.

15. A device as claimed in claim 12, in which the applicator is a brush.

16. A device as claimed in claim 12, in which the applicator is a sponge roller.

17. A device as claimed in claim 7, in which the applicator is a sponge roller.

18. A device as claimed in claim 7, in which another compartment contains a coloring composition.

19. A device as claimed in claim 8, in which another compartment contains a coloring composition.

20. A liquid applicator device for applying compositions to hair in the course of cosmetically treating the same; said device comprising:

a compressible generally cylindrical container for receiving said composition;

a removable cap closing the top of said container and being in flow communication with an axial extension thereof having a central flow passage therein for receiving flow of said composition upon compression of said container;

an applicator brush positioned at the end of said axial extension remote from said container, for receiving and distributing said composition; and a non-dispensing hair-parting wand extending from said cap along an axis which diverges from the axial direction of said extension and brush and from the longitudinal axis of said container, the distal end of said hair-parting wand being spaced from and unobstructed by the applicator to enable manipulation of the hair without interference by the applicator.

* * * * *